US009030109B2

(12) United States Patent
Li et al.

(10) Patent No.: US 9,030,109 B2
(45) Date of Patent: May 12, 2015

(54) LED CURRENT BALANCE DRIVING CIRCUIT

(75) Inventors: Chien-Ching Li, Taoyuan County (TW); Chung-Ming Leng, Taoyuan County (TW)

(73) Assignee: Niko Semiconductor Co., Ltd., New Taipei (TW)

( * ) Notice: Subject to any disclaimer, the term of this patent is extended or adjusted under 35 U.S.C. 154(b) by 100 days.

(21) Appl. No.: 13/555,029

(22) Filed: Jul. 20, 2012

(65) Prior Publication Data

US 2013/0134887 A1 May 30, 2013

(30) Foreign Application Priority Data

Nov. 28, 2011 (TW) ..... 100143459 A

(51) Int. Cl.
*H05B 37/00* (2006.01)
*H05B 33/08* (2006.01)

(52) U.S. Cl.
CPC ..... *H05B 33/0824* (2013.01)

(58) Field of Classification Search
CPC ..... H05B 33/0815; H05B 33/0827; H05B 37/02; H05B 37/032; H05B 37/04; H05B 39/06; H05B 41/36
USPC ..... 315/185 R, 186, 192, 291, 294, 299, 315/302, 307, 308, 224, 274
See application file for complete search history.

(56) References Cited

U.S. PATENT DOCUMENTS

| | | | | |
|---|---|---|---|---|
| 2003/0141829 | A1* | 7/2003 | Yu et al. | 315/276 |
| 2011/0068700 | A1* | 3/2011 | Fan | 315/185 R |
| 2012/0013259 | A1* | 1/2012 | Jin | 315/185 R |
| 2012/0146546 | A1* | 6/2012 | Hu et al. | 315/297 |
| 2012/0293080 | A1* | 11/2012 | Xu et al. | 315/186 |

FOREIGN PATENT DOCUMENTS

| | | | |
|---|---|---|---|
| CN | 1863423 | A | 11/2006 |
| CN | 101510723 | A | 8/2009 |
| CN | 101699922 | A | 4/2010 |
| CN | 101795518 | A | 8/2010 |
| CN | 1863423 | A | 11/2010 |
| CN | 201766748 | U | 3/2011 |
| JP | 2010183656 | A | 8/2010 |
| TW | 201220930 | A | 5/2012 |

* cited by examiner

*Primary Examiner* — Tung X Le
(74) *Attorney, Agent, or Firm* — Li & Cai Intellectual Property (USA) Office

(57) ABSTRACT

A LED current-balance driving circuit having a current-balance coil set, a switching unit, and a control circuit is provided. The current-balance coil set has at least a first coil and a second coil, both of which are in connection with respective LED strings, for balancing currents flowing through the LED strings. The switching unit and a leakage inductance of current-balance coil set are utilized to facilitate the voltage conversion for driving the LED strings. A duty cycle of the switching unit is controlled by the control circuit according to the currents flowing through the LED strings.

13 Claims, 6 Drawing Sheets

LED CURRENT BALANCE DRIVING CIRCUIT

BACKGROUND OF THE INVENTION

1. Field of the Invention

The instant disclosure relates to a light-emitting diode (LED) current-balance driving circuit; in particular, to a LED current-balance driving circuit utilizing a current-balance coil for achieving the goal of the current balance.

2. Description of Related Art

As liquid crystal displays (LCD) are widely utilized in various fields, the traditional backlight of the LCDs utilizes cold-cathode fluorescent lamps (CCFLs), which are gradually replaced by white LEDs in order to be more environmental friendly.

Compared with the cold-cathode fluorescent lamps, the LEDs do not contain mercury and are smaller in size, longer in life-duration, and better in color saturation.

That said, since a forward bias (Vf) for each of the LEDs may not the same, a driving voltage level for each of LED strings may be different from each other as the LEDs strings are connected in parallel. Therefore, a LED current-balance driving circuit becomes necessary.

FIG. 1 shows a circuit diagram of a traditional LED current balance driving circuit for a backlight source of a display device. The traditional LED current balance driving circuit includes a power supply 20 and a current-balance circuit. The current-balance circuit includes a plurality of switching units Q1, a plurality of resistors R1, and a control circuit 30. The power supply 20 provides the driving current for driving each of the LED strings 10 according to a feedback signal (not shown in FIG. 1). The current-balance circuit is for balancing the current flowing through each of the LED strings 10. As shown in the FIG. 1, a low voltage terminal of each of the LED strings 10 is serially connected to the corresponding switching unit Q1 and the resistor R1. The control circuit 30 detects a voltage level at a high voltage terminal of each of the resistors R1, and controls operations of the corresponding switching unit Q1 according to the detected voltage level at the high voltage terminal, for adjusting the currents flowing through each of the LED strings 10 in order to ensure the currents flowing through each of the LED strings 10 can be the same.

The traditional LED current balance driving circuit requires multiple switching units and multiple resistors to achieve the goal of the current balance, which is complicated and not cost-efficient. Additionally, the power supply 20 for the traditional LED current balance driving circuit powers the backlight source by using DC to DC conversion. Due to the boost limitation associated with the DC to DC conversion, the backlight source may not be properly powered especially in the application of the display device that is larger in size, and therefore the performance of the brightness of the display device remains to be desired.

Thus, how to provide a low cost LED driving circuit for driving multiple LED strings (with the LEDs connected serially or in parallel connection), improving the performance of the brightness of the display device with large size, and balancing the currents flowing through the LED strings, is among objectives of the instant disclosure.

SUMMARY OF THE INVENTION

The objective of the instant disclosure is to provide a LED current-balance driving circuit. The LED current-balance driving circuit simplifies the design of traditional LED current-balance driving circuit. Additionally, when an abnormality occurs in the LED (for example, the LED is shorted), the LED current-balance driving circuit of the instant disclosure avoids the normal LED element from being damaged due to the excessive current.

In order to achieve the aforementioned objectives, according to an embodiment of the instant disclosure, a LED current-balance driving circuit is offered. The LED current-balance driving circuit receives an input voltage to drive a plurality of LED strings. The LED current-balance driving circuit includes a current-balance coil set, a switching unit, and a control circuit. The current-balance coil set has at least a first coil and a second coil, each of the first coil and the second coil is serially connected to its respective LED string for balancing currents flowing through the LED strings. The switching unit is electrically coupled to the current-balance coil set and a leakage inductance of the current-balance coil set may facilitate the conversion of the input voltage for driving the LED strings. The control circuit detects the currents flowing through the LED strings for controlling the duty cycle of the switching unit.

In one embodiment of the present disclosure, the LED current-balance driving circuit has an auxiliary magnetizing inductor serially connected to the current-balance coil set.

In one embodiment of the present disclosure, the switching unit, the leakage inductance of the current-balance coil set and a rectifying diode constitutes a boost converter.

In one embodiment of the present disclosure, the switching unit, the leakage inductance of the current-balance coil set and a rectifying diode constitutes a buck converter.

In one embodiment of the present disclosure, the switching unit, the leakage inductance of the current-balance coil set and a rectifying diode constitutes a fly-back converter.

In one embodiment of the present disclosure, a first coil and a second coil of the current-balance coil set are at opposite sides of the current-balance coil set.

In order to further the understanding regarding the instant disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

A LED current balance driving circuit of the present disclosure utilizes the coil set capable of balancing currents flowing through LED strings, and employs a leakage inductance of the coil set as an energy storing inductor for achieving the goal of voltage step-up and step-down and balancing the currents. The present disclosure utilizes a first order converting circuit for driving the LED strings by magnetizing the currents and balancing the same.

Figure 1:
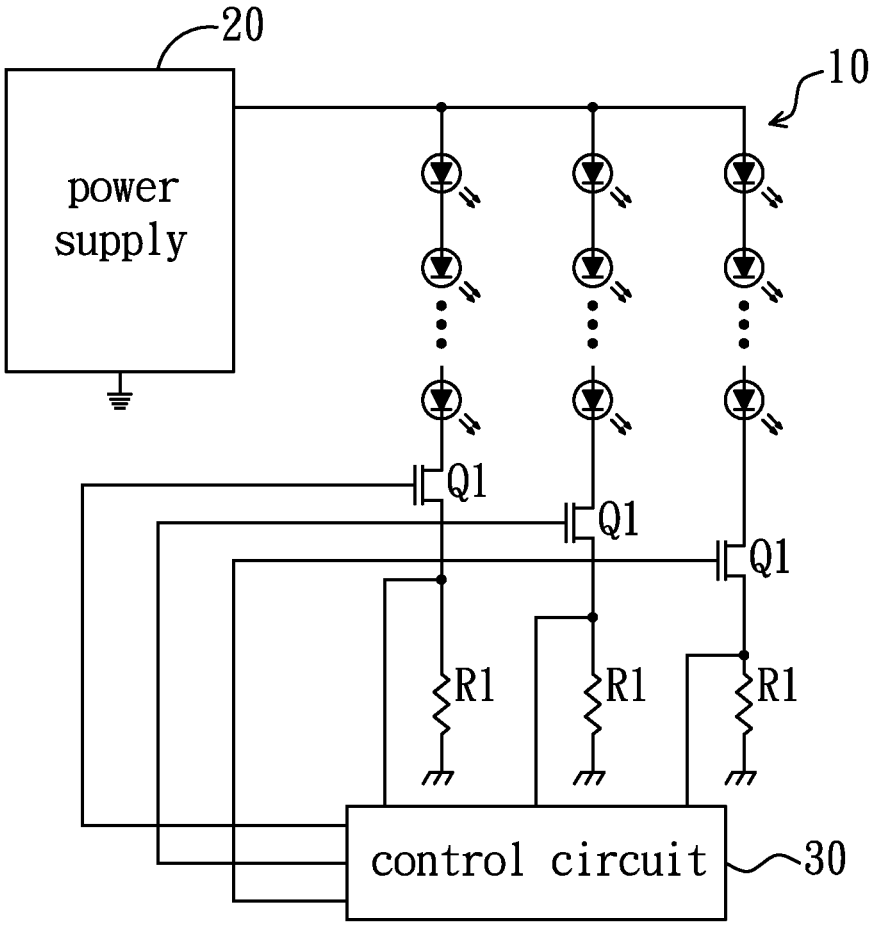
FIG. 1 shows a circuit diagram of a traditional LED current-balance driving circuit.
Figure 2:
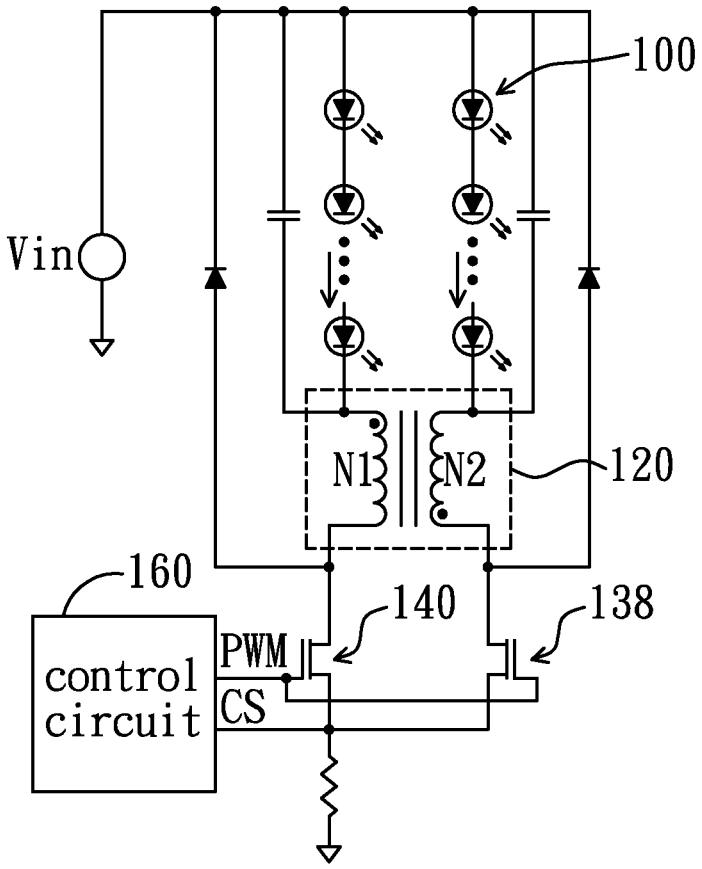
FIG. 2 shows a circuit diagram of a LED current-balance driving circuit according to an embodiment of the present disclosure.

FIG. 2 shows a circuit diagram of a LED current-balance driving circuit according to an embodiment of the present disclosure. In this embodiment, a driving circuit with a buck converter is described as an example; however, the present disclosure is not restricted thereto. The design manner of the present disclosure may also be applied to a boost converter, a fly-back converter, or other converting circuit utilizing a switching unit and a magnetizing inductor.

As shown in FIG. 2, the LED current balance driving circuit may receive an input voltage Vin to drive a plurality of LED strings 100 (e.g. two LED strings are shown in FIG. 2). The LED current balance driving circuit may include a current-balance coil set 120, two switching units 138 and 140, and a control circuit 160. The current-balance coil set 120 may also include a first coil N1 disposed on a first side of the current-balance coil set 120 and a second coil N2 disposed on a second side of the current-balance coil set 120 for balancing current flowing through each of the LED strings 100. In one implementation, the first side and the second side are opposite. The switching unit 138 and 140 may be electrically coupled to the second coil N2 and the first coil N1, respectively. A detecting terminal CS of the control circuit 160 may be configured to detect the current flowing through the LED strings 100 to generate a pulse width modulating (PWM) control signal for controlling the duty cycle of the switching units 138 and 140.

When the current-balance coil set 120 operates for the purpose of balancing the currents flowing through the LED strings 100, the directions of the currents flowing through each of the LED strings 100 are represented in the direction of the arrow shown in FIG. 2. The current-balance coil set 120 may operate as a transformer, with the current flowing into the current-balance coil set 120 at a terminal (dotted) of the first coil N1, and flowing out the current-balance coil set 120 at a terminal (dotted) of the second coil N2. Therefore, the currents flowing through each of the LED strings may be balanced.

Ideally, the coupling efficient of the first coil N1 and the second coil N2 is 1. Thus, magnetic fields excited by the first coil N1 and the magnetic field excited by the second coil N2 may cancel out each other. In other words, the magnetized inductance of the first coil N1 and the magnetized inductance of the second coil N2 may not store energy due to the cancellation of the magnetic fields. However, in reality, the presence of a leakage inductance may not be avoided. As such, the leakage inductance of the current-balance coil set 120 may be further utilized as the magnetizing inductance for the operation of the converter. And the switching units 138 and 140 may be controlled for adjusting the timing of the input voltage Vin charging the current-balance coil set 120 so that the input voltage may be converted to the output voltage for driving the LED strings 100.

The leakage inductance of the current-balance coil 120 is may be far less than the main inductance of the current-balance coil 120. However, the leakage inductance as the magnetizing inductance may be suitable in the converter driven at a high frequency (such as frequencies ranging from 300 kHz to 1 MHz). For example, the traditional step-up voltage converting circuit boosts the input voltage of 12V~24V to 40V~100V for driving the LED strings, while the present disclosure boosts the input voltage of 30V~60V to 40V~100V. In other words, the traditional voltage converting circuit may be associated with a larger step-up ratio and lower conversion efficiency when compared with the present disclosure. Meanwhile, as the step-up ratio decreases, the required magnetizing inductance lowers. For example, in the display device applications, the operation frequency of the converter is 300 kHz, and the magnetizing inductance is about 25 uH for stepping-up 12V to 50V. But with the same operation frequency for stepping up 40V to 50V, the magnetizing inductance of 7.5 uH may be required.

In FIG. 2, the switching units 138 and 140 are disposed at a low voltage terminal of the LED string 100. However, the present disclosure is not restricted thereto. The switching units 138 and 140 may alternatively be disposed at a high voltage terminal of the LED strings 100. Besides, despite two switching units 138 and 140 are utilized to convert the input voltage in FIG. 2, in another implementation a single switching unit may be sufficient to serve the same purpose.

Figure 3:
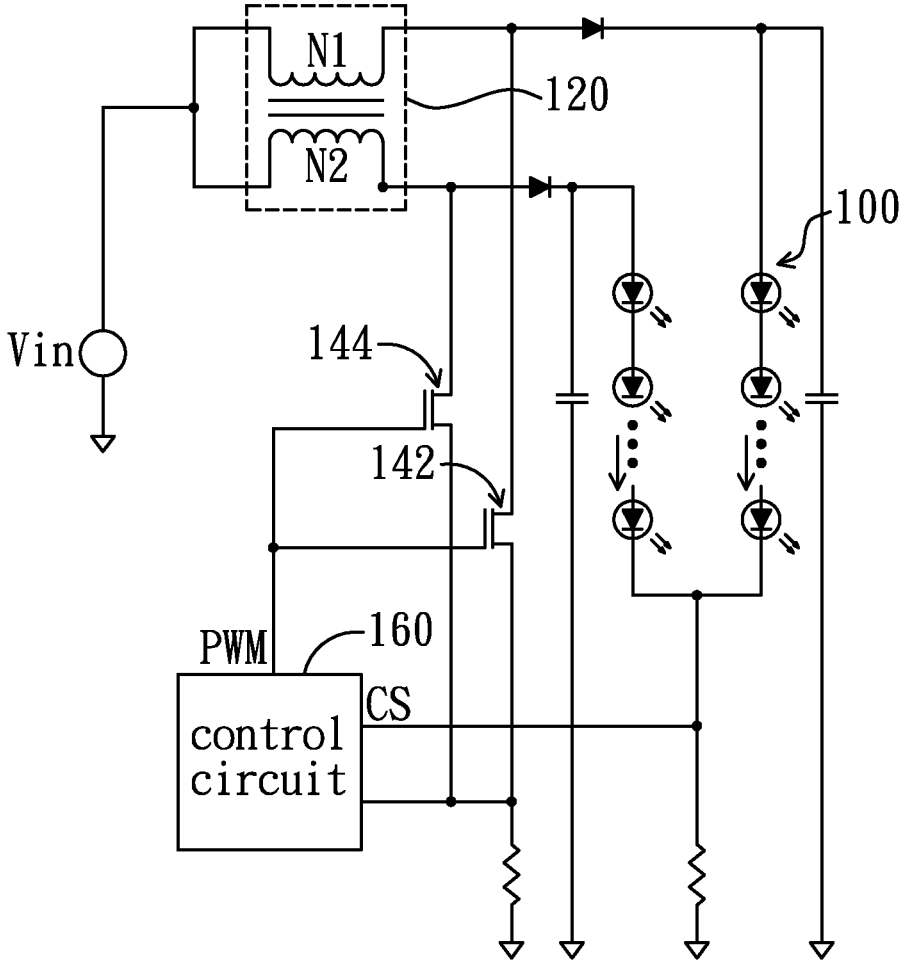
FIG. 3 shows a circuit diagram of a LED current-balance driving circuit according to another embodiment of the present disclosure.

FIG. 3 shows a circuit diagram of a LED current-balance driving circuit according to another embodiment of the present disclosure. Different from the embodiment of FIG. 2, the LED current-balance driving circuit in FIG. 3 is a boost converter. As shown in FIG. 3, the driving circuit has two switching units 142 and 144 coupled to a first coil N1 and a second coil N2, respectively. The control circuit 160 may detect currents flowing through the LED strings 100, and simultaneously controls the duty cycle of the two switching unit 142 and 144 for adjusting the currents flowing through the LED strings 100.

Figure 4:
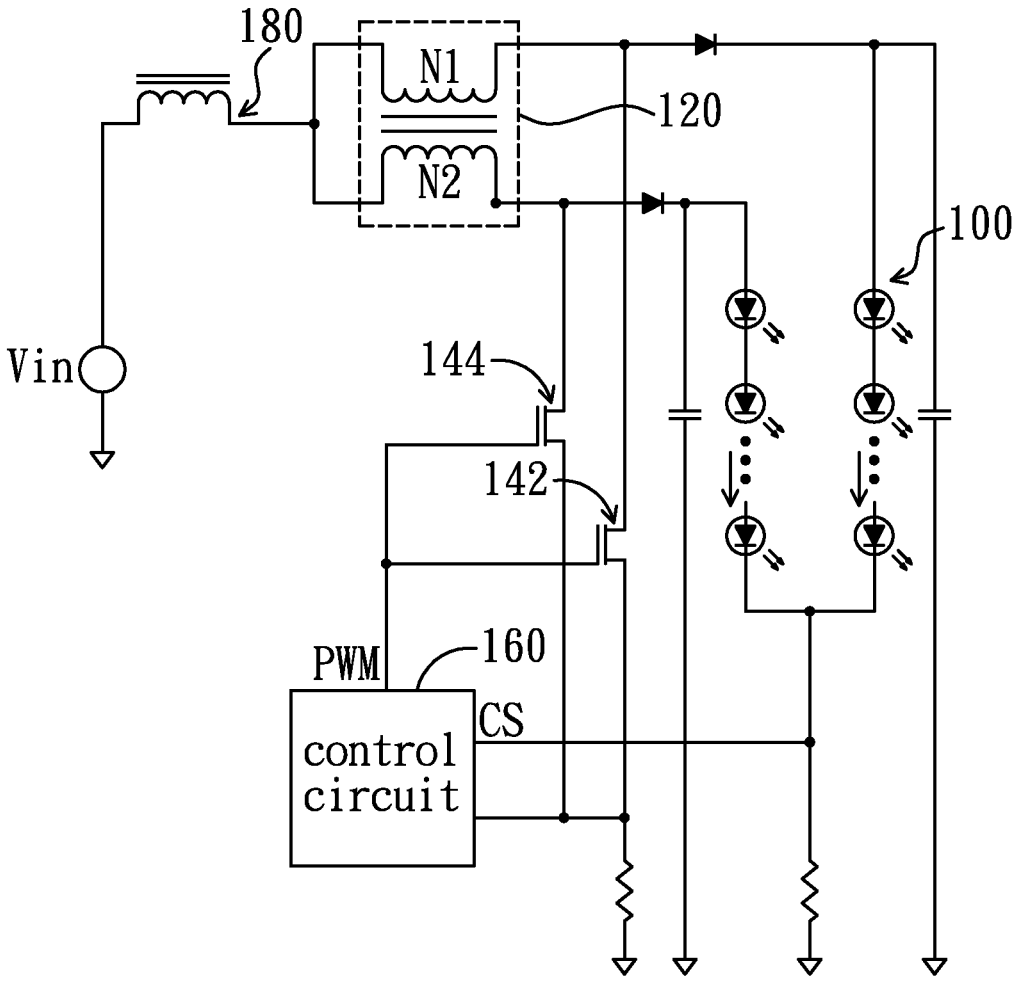
FIG. 4 shows a circuit diagram of a LED current-balance driving circuit according to another embodiment of the present disclosure.

As previously mentioned, the leakage inductance of the current-balance coil set 120 may be sufficient for the purpose of the voltage conversion when the converter operates in a relatively higher frequency. But in the condition of the low-frequency operation the leakage inductance of the current-balance coil set 120 standing alone may not be satisfactory. Therefore, FIG. 4 in which a circuit diagram of a LED current-balance driving circuit according to another embodiment of the present disclosure is illustrated may provide a solution. Different from the embodiment shown in FIG. 2, an auxiliary magnetizing inductor 180 may be serially connected to the current-balance coil set 120. The auxiliary magnetizing inductor 180 is serially connected between the current-balance coil set 120 and the input voltage Vin for increasing the magnetizing inductance. The purpose of adding the auxiliary magnetizing inductor 180 is for supplementing the magnetizing inductance and the position where the auxiliary magnetizing inductance may be placed within the knowledge domain of ordinary skilled people.

Figure 5:
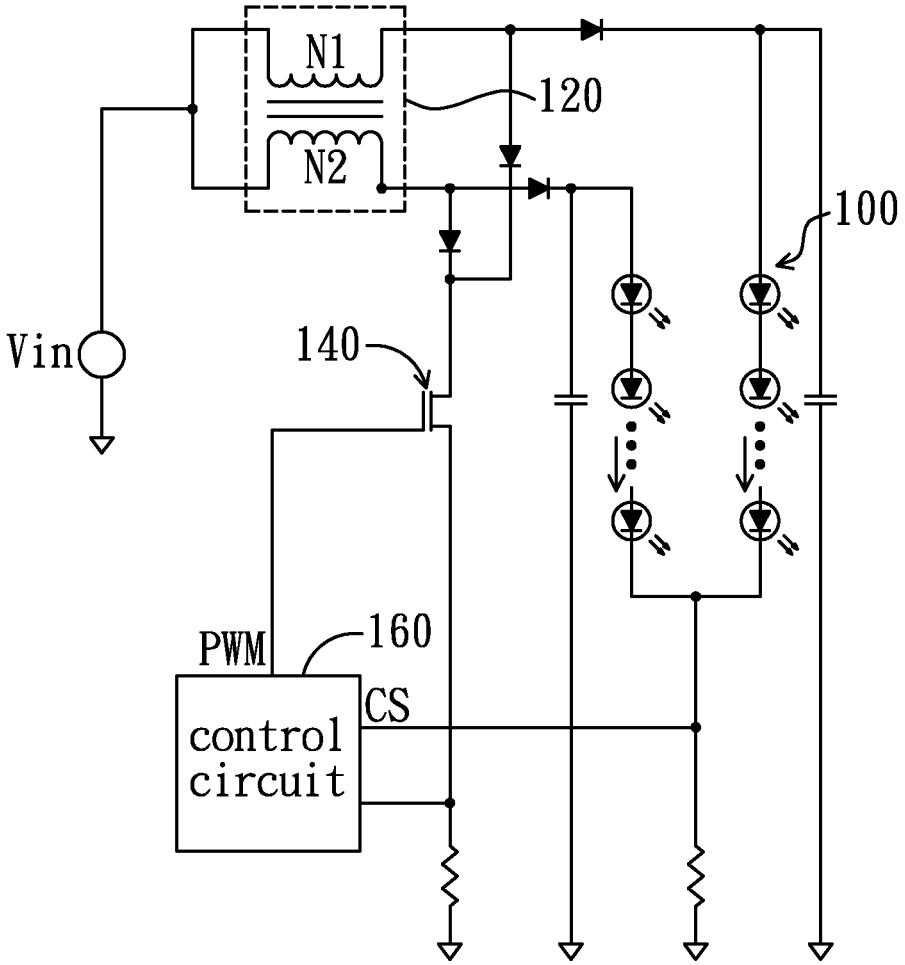
FIG. 5 shows a circuit diagram of a LED current-balance driving circuit according to another embodiment of the present disclosure.

FIG. 5 shows a circuit diagram of a LED current-balance driving circuit according to another embodiment of the present disclosure. Different from the embodiment shown in FIG. 3, the embodiment in FIG. 5 utilizes only one switching unit 140 to adjust the currents flowing through the LED strings 100. The switching unit 140 may be connected to the first coil N1 and the second coil N2. By controlling the duty cycle of the switching unit 140, the currents flowing through each of the LED strings 100 may be therefore balanced. Although in FIG. 5 the switching unit 140 is connected to the first coil N1 and the second coil N2, the present disclosure is not restricted thereto. The switching unit 140 may be only connected to the first coil N1 or only connected to the second coil N2.

Figure 6:
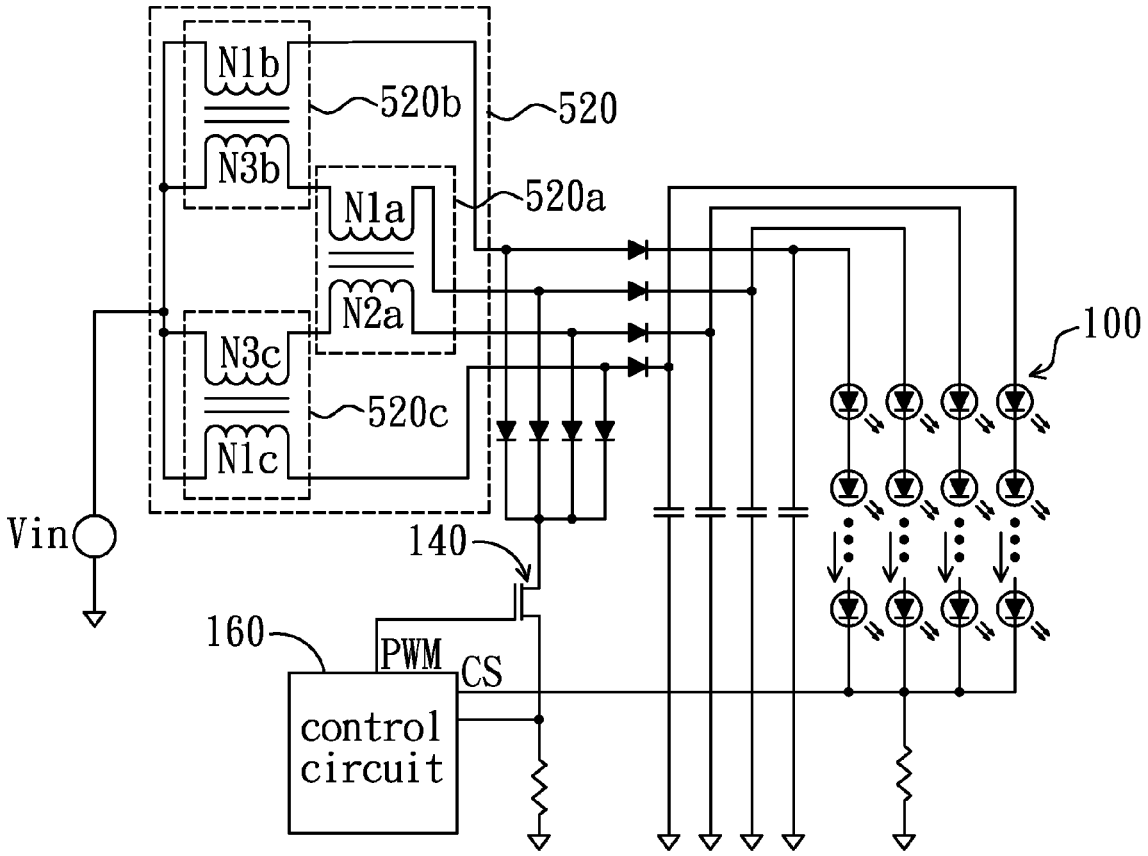
FIG. 6 shows a circuit diagram of a LED current-balance driving circuit according to another embodiment of the present disclosure.

FIG. 6 shows a circuit diagram of a LED current-balance driving circuit according to another embodiment of the present disclosure. Different from the embodiment shown in FIG. 2, a current-balance coil set 520 in FIG. 6 has three transformers 520*a*, 520*b*, and 520*c*. The transformers 520*a*, 520*b*, and 520*c* have two coils N1*a* and N2*a*, N1*b* and N3*b*, and N1*c* and N3*c*, respectively. The first transformer 520*a* may have two output coils N1*a* and N2*a* while each of the second transformer 520*b* and the third transformer 520*c* may have a single output coil, namely an output coil N1*b* and N1*c*, and single balance coil N3*b* and N3*c*. The four output coils N1*a*, N2*a*, N1*b*, and N1*c* may be connected to the LED strings 100. The balance coils N3*b* and N3*c* may be serially connected to the output coils N1*a* and N2*a* of the first transformer 520*a*.

An artisan of ordinary skill in the art will appreciate how to make an equivalent change to the present disclosure after reading the disclosure in its entirety. For example, the current-balance coil set 120 shown in FIG. 2 may have a first coil (or winding) N1 corresponding to a second coil (or winding) N2. Meanwhile, a third coil may be further incorporated so that the first coil/winding N1 may correspond to both the second coil/winding N2 and the third coil/winding. Furthermore, the current-balance coil set 120 shown in FIG. 2 has only one transformer for balancing the currents flowing through two LED strings, however, the current-balance coil set of the present disclosure may have two transformers for balancing the currents flowing through four LED strings.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. A LED current-balance driving circuit for LED strings, comprising:

a current-balance coil set for balancing currents flowing through at least two of the LED strings, wherein a leakage inductance of the current-balance coil set is utilized to be an energy storing inductor of a converter for converting an input voltage to drive the LED strings;

only one switching unit, electrically coupled to the current-balance coil set and the LED strings, for operating along with the leakage inductance of the current-balance coil set to convert the input voltage for driving the LED strings; and only one control circuit, for detecting the currents flowing through the LED strings and controlling a duty cycle of the switching unit;

wherein the current-balance coil set further comprises at least a first coil and a second coil, the first coil is disposed at a first side of the current-balance coil set and the second coil is disposed at a second side of the current-balance coil set, with the first side being opposite to the second side.

2. The LED current-balance driving circuit according to claim 1, further comprising:

an auxiliary magnetizing inductor, serially connected to the current-balance coil set.

3. The LED current-balance driving circuit according to claim 1, with the first coil and the second coil serially connected to the respective LED strings for balancing the currents flowing through the LED strings.

4. The LED current-balance driving circuit according to claim 3, wherein a terminal of the first coil is connected to a terminal of the second coil, and another terminal of the first coil and another terminal of the second coil are serially connected to one of the LED strings, respectively.

5. The LED current-balance driving circuit according to claim 1, further comprising:

a rectifying diode, electrically coupled to the current-balance coil set.

6. The LED current-balance driving circuit according to claim 1, wherein the control circuit outputs a pulse width modulating (PWM) control signal to control the switching unit.

7. The LED current-balance driving circuit according to claim 1, wherein the converter is a boost converter, a buck converter or a fly-back converter.

8. The LED current-balance driving circuit according to claim 1, wherein the current-balance coil set is a choke.

9. A LED current-balance driving circuit for LED strings, comprising:

a current-balance coil set for balancing currents flowing through at least two of the LED strings, wherein a leakage inductance of the current-balance coil set is utilized to be an energy storing inductor of a converter for converting an input voltage to drive the LED strings; and only two switching units, electrically coupled to the current-balance coil set and the LED strings respectively, for operating along with the leakage inductance of the current-balance coil set to convert the input voltage for driving the LED strings; and only one control circuit, for detecting the currents flowing through the LED strings and controlling a duty cycle of the switching units;

wherein the current-balance coil set further comprises at least a first coil and a second coil, the first coil is disposed at a first side of the current-balance coil set and the second coil is disposed at a second side of the current-balance coil set, with the first side being opposite to the second side.

10. The LED current-balance driving circuit according to claim 9, wherein the current-balance coil set further comprises at least a first coil and a second coil, with the first coil and the second coil serially connected to the respective LED strings for balancing the currents flowing through the LED strings.

11. The LED current-balance driving circuit according to claim 9, further comprising:

a rectifying diode, electrically coupled to the current-balance coil set.

12. The LED current-balance driving circuit according to claim 9, wherein the control circuit outputs a pulse width modulating (PWM) control signal to control the switching unit.

13. The LED current-balance driving circuit according to claim 9, wherein the current-balance coil set is a choke.

* * * * *